US006478631B1

(12) United States Patent
Dutton et al.

(10) Patent No.: US 6,478,631 B1
(45) Date of Patent: Nov. 12, 2002

(54) ELECTRICAL CONNECTOR WITH SPLIT SHELLS AND RETENTION CLIP

(75) Inventors: Peter Dutton, Fremont, CA (US); Mohamed H. Higgy, Redwood City, CA (US); Jason T. Valenta, San Jose, CA (US); Timm Seaton, Fremont, CA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/464,649

(22) Filed: Dec. 15, 1999

Related U.S. Application Data

(63) Continuation of application No. 09/085,311, filed on May 27, 1998, now abandoned.

(51) Int. Cl.[7] ..... H01R 33/05

(52) U.S. Cl. ..... 439/707; 439/608; 439/701; 439/903

(58) Field of Search ..... 439/701–708, 439/607–612, 903, 906, 731

(56) References Cited

U.S. PATENT DOCUMENTS

| | | | | |
|---|---|---|---|---|
| 3,671,921 A | | 6/1972 | Baker, III et al. | |
| 3,711,813 A | | 1/1973 | Bryant | |
| 3,885,849 A | | 5/1975 | Bailey et al. | |
| 3,926,499 A | | 12/1975 | Bailey et al. | |
| 3,993,394 A | | 11/1976 | Cooper | |
| 4,084,882 A | | 4/1978 | Hogan et al. | |
| 4,361,376 A | | 11/1982 | Gallusser et al. | |
| 4,413,875 A | | 11/1983 | Mattingly | |
| 4,558,916 A | * | 12/1985 | Hehl | 439/610 |
| 4,619,490 A | | 10/1986 | Hawkings | |
| 4,659,162 A | | 4/1987 | Cartesse | |
| 4,764,130 A | * | 8/1988 | Diclemente | 439/868 |
| 4,927,388 A | * | 5/1990 | Gutter | 439/660 |
| 4,944,568 A | * | 7/1990 | Danbach et al. | 439/248 |
| 4,985,002 A | | 1/1991 | Maisch et al. | |
| 5,125,854 A | | 6/1992 | Bassler et al. | |
| 5,145,411 A | | 9/1992 | Pastal | |
| 5,244,405 A | | 9/1993 | Broschard, III et al. | |
| 5,244,415 A | * | 9/1993 | Marsilio et al. | 439/610 |
| 5,676,569 A | * | 10/1997 | Davis | 439/731 |

FOREIGN PATENT DOCUMENTS

| | | |
|---|---|---|
| DE | 3 328 242 A1 | 2/1985 |
| EP | 0 450 281 A1 | 10/1991 |

OTHER PUBLICATIONS

European International Search Report for International Application No. PCT/US99/11897 dated Sep. 24, 2000.

* cited by examiner

*Primary Examiner*—Lincoln Donovan

(57) ABSTRACT

The present electrical connector assembly includes an outer shell capable of receiving at least one electrical contact module. The outer shell works in cooperation with an improved contact module retaining device which secures the electrical contact module within the shell. The combination of the outer shell with the contact module retaining device protects the critical elements of the retaining device from exterior environments, does not interfere with insertion of the module into the shell, and provides for a precise alignment of the module during and after insertion of the module into the shell. In particular, the outer shell is comprised of two half shells which are open during attachment of a contact module retaining device to each of the half shells. The two half shells are joined to form a connector housing after attachment of the module retaining device. The preferred module retaining device is a clip which is attached so that the main body of the clip is in contact with an interior surface of the half shell. The clip is precisely aligned within the half shell using snap fit contacts which hold the clip in position until the half shells are joined, after which the clips may be held in position by contact with the interior surface of the half shell alone.

12 Claims, 4 Drawing Sheets

ELECTRICAL CONNECTOR WITH SPLIT SHELLS AND RETENTION CLIP

CROSS-REFERENCE TO RELATED APPLICATIONS

This application is a continuation of U.S. patent application Ser. No. 09/085,311 filed May 27, 1998, now abandoned.

BACKGROUND OF THE INVENTION

1. Field of the Invention

The present invention relates to the field of electrical connectors, and more particularly to a two-part connector shell assembly which enables the use of a specialized retainer clip. Due to the ability to open the connector shell assembly for insertion of the clip, the clip can be attached to the shell assembly in a manner which provides easy and precise alignment. Further, the clip design provides for load distribution in a manner which reduces stress fatigue.

2. Brief Description of the Background Art

Electrical connectors are available in a multitude of different designs, to serve a broad base of requirements. A frequently used design includes a plug and receptacle, each of which includes a contact or terminal module, including a dielectric housing in which contacts or terminals are secured; and a shell member surrounding the housing for physical protection and also for shielding and grounding purposes. Conventional methods for securing the contact module within the protective shell include the use of adhesive materials, locking rings, or other retention hardware.

Examples of electrical connectors which are useful in the applications for which the present connector is useful are described below, to provide a background for the present improved connector.

U.S. Pat. No. 3,993,394 to James Cooper, issued Nov. 23, 1976, discloses a connector half having substantially parallel transverse walls joined by perpendicular sides to provide a substantially rectangular cross-section to receive at least one flat connector wafer inserted therein in a forward axial direction. A transverse rib is formed on an upper face of a wafer facing an inner face of a connector transverse wall. A spring clip cantilevered on the inner face of the connector half is provided. When the wafer is inserted into the connector half, the rib acts as a cam against the spring clip, forcing the spring clip up. The spring clip returns to abut the rear of the rib as the wafer is pushed into position, to retain the wafer in the connector half. A tool is provided for camming the spring clip to allow removal of the wafer.

U.S. Pat. No. 4,619,490 to Robert Hawkings, issued Oct. 28, 1986, describes a guidance and retention device for terminated connector wafers having a housing and at least one pair of opposed wafer retention members, said members releasably secured to opposed walls of the housing to provide the guidance and retention of rectangular-shaped connector wafers therebetween. The wafer retention members are described as being easily relocated to allow for reorganization of connector wafers and of a wiring array. In particular, these retention members comprise one member releasably connected to a first opposed wall and the other member releasably connected to a second opposed wall, each member having a plurality of guidance portions and retention portions which guide conductor wafers which are inserted in a stacked relationship within the housing.

U.S. Pat. No. 4,764,130 to Thomas DiClemente, issued Aug. 16, 1988, discloses an electrical connector having a retaining member which has a transverse section seated in an aperture in the connector housing. The forward end of the retaining member is folded back on itself and fits into an opening in the connector housing. A pair of retaining legs extend outwardly from the transverse section to engage an inside surface of the connector housing; these retaining legs work in cooperation with the folded member to hold the retaining member in position within the connector housing. In addition, a second pair of retaining legs extend inwardly into the connector housing passageway to retain the terminal housing in position within the connector housing. The metal shell (connector housing) which surrounds the terminal housing is of a single piece construction, and is used in combination with retaining members are formed from a metal as well, and are described as being stamped and formed from a material having desirable spring characteristics, such as, for example, stainless steel.

U.S. Pat. No. 4,927,388 to David Gutter, issued May 22, 1990 discloses a single piece protective shell of an electrical connector which includes clip members affixed to the inside of the protective shell, with spring arms of the clips extending forwardly and inwardly to latch behind transverse ribs along the outwardly facing surfaces of the terminal modules inserted into the shell. Each clip includes a pair of outwardly directed tabs along lateral edges of the body section, and the tabs are inserted outwardly through associated longitudinal slits in the shell wall and then bent over along the outward surface of the shell, preferably into recesses to be flush with the outward shell surface. A pair of such clips along the upper inside surface and along the lower inside surface cooperate to retain a pair of terminal modules inserted into the shell.

U.S. Pat. No. 5,125,854 to Bassler et al., issued Jun. 30, 1992 describes an electrical connector assembly which includes a shield and frame member wherein at least a portion thereof is conductive. A plurality of modular sub-assemblies is mounted in the assembly. A latch mechanism is provided for removably securing each modular sub-assembly to the shield and frame member. The latch mechanism includes a tab which extends from the shield and frame member, wherein the tab has a slot which fits over a projection on the modular sub-assembly.

U.S. Pat. No. 5,145,411 to Pastal et al., issued Sept. 8, 1992, describes a dielectric insert of an electrical connector retained within a metal shell by a plurality of latching ledges formed integrally with the insert member. The ledges are spaced about the periphery of the outer surface of the insert member, and during insertion into the shell member, these ledges are engaged with corresponding stop surfaces defined along inside surfaces of the metal shell.

Many of the electrical connectors described above find use in airline applications, and particularly for signal transmission applications. Due to the criticality of reliable performance, the connectors must meet stringent requirements. The exterior of the connector (the shell) is typically conductive and provides electromagnetic shielding. The connector as a whole is tested for mechanical durability, resistance to chemicals and to salt spray. For example, airline connectors are tested for vibration resistance per military standard MIL-STD-1344, which requires that there be no damage or electrical discontinuity after vibration testing.

In addition to the requirements for the exterior shell, the connector must provide a means of securing terminal modules within the shell. The means for securing the module should not interfere with insertion of the module into the shell, should not expose the securing means to the exterior environment in a manner which may cause the securing means to fail, and should provide for a careful alignment of the modules within the shell. This latter feature ensures proper electrical engagement within the connector.

Not only must the connector meet the technical requirements specified above, but as always, the cost of manufacturing the connector is an important consideration.

SUMMARY OF THE INVENTION

The present electrical connector assembly includes an outer shell capable of receiving at least one electrical contact module The outer shell works in cooperation with an improved contact module retaining device which secures the electrical contact module within the shell. The combination of the outer shell with the module retaining device protects the critical elements of the retaining device from exterior environments, does not interfere with insertion of the contact module into the shell, and provides for a precise alignment of the module during and after insertion of the contact module into the shell.

In particular, a complete electrical connector includes both a plug and a receptacle, and the following description applies to each. The outer shell is comprised of two halves which are open during attachment of a contact module retaining device to each half shell. The two halves are closed after attachment of the contact module retaining device. Preferably, the shell halves, with contact module retaining device in place, are permanently riveted into the closed configuration. A tool is provided which permits easy release of a contact module, if necessary. Typically the outer shell is rectangular in shape and is fabricated from aluminum which is cadmium or nickel plated, depending on the end use application. Preferably the shell halves are cast (using standard casting techniques) rather than machined, to reduce costs. The closed, assembled shell with module retaining device in place is capable of encompassing at least the portion of a contact module which contains the contacts and is capable of retaining the module after insertion into the assembled shell.

The preferred retaining device which secures the electrical contact module within the shell is a clip. In the preferred embodiment, a clip is attached so that the main body of the clip is in contact with an interior surface of each half of the outer shell. When a contact module (which is generally rectangular) is inserted into the connector assembly, the contact module is held in place by a clip on each opposing side (exterior surface) of the module. Initially (prior to closing of the half shells to form an assembled shell with module retaining device) each clip is attached to the half shell by a snap fit. After the shell is closed and riveted (or otherwise fastened together), the clip is entrapped by the walls of the shell and is secured at the proper position by contact with the surfaces of the closed shell.

The retaining clip snap fit includes four (4) mechanical contact points which snap into place and a fifth contact point which is an insert shape which extends through an opening in the half shell and is subsequently bent or folded to lie flat within a recession on the exterior of the half shell. Two of the snap fit contact points work in conjunction with the insert to align and secure the clip against a half shell interior surface relative to the leading end and trailing end of the connector. The remaining two of the snap fit contact points align and secure the clip against the shell half interior surface relative to the side edges of the connector, which together with the leading and trailing ends form the rectangular connector body. The side edge snap fit contact points secure the clip so that it cannot become canted at an angle from side edge to side edge of the shell. This five point positioning (alignment and securing) of the retaining clip within the half shell interior ensures proper alignment of the clip prior to joining together of the two half shells. After joining of the two half shells, the clip is trapped in the proper alignment, ensuring proper alignment of the contact module upon insertion into the shell. This proper alignment is critical in ensuring proper electrical engagement between contact modules when two electrical connector assemblies are joined to produce an electrical connection.

Due to the rectangular shape of the preferred embodiment connector and the accurate alignment of the retaining clip within the connector shell, an entirely parallel alignment of connecting electrical contact modules is obtained. This parallel alignment enables proper electrical engagement and ease in sealing of the electrically engaged contact elements from the environment.

The use of two half shells each having a module retaining clip attached thereto gives rise to a particular method of fabricating an electrical connector assembly, the method comprising:

a) snap fitting a retention clip into contact with an interior surface of a half shell while simultaneously inserting a protrusion from the clip surface through an opening in the half shell;

b) mechanically securing the protrusion to the exterior surface of the half shell;

c) joining two half shells together to form an assembly comprising an exterior shell having a protective outer surface, with a contact module retaining device on the interior surface of each half shell, wherein the assembly is capable of encompassing at least the portion of an inserted contact module, and is capable of retaining the contact module after its insertion into the assembly.

Preferably the snap fitting of the contact module retention clip to the half shell occurs by snap fitting of a first pair of snap fit points which secure the retention clip in the direction of the leading and trailing edges of the connector. Preferably the snap fit points are in the form of pre-bent tabs extending from the upper surface of the clip. The upper surface of the clip is placed adjacent to the interior surface of the half shell, and the pre-bent tabs slide into position against the half shell through openings in the half shell and rest against recessed surfaces on the exterior surface of the half shell. As the pre-bent tabs slide into position, an insert shape, which is preferably a substantially straight tab, is inserted through an opening in the shell, to extend up through to the exterior of the half shell. This provides a three point alignment and a secure attachment of the retention clip to the half shell in the direction from leading edge to trailing edge of the connector assembly. A second pair of snap fit points, which align and secure the retaining clip against the shell half interior surface relative to the side edges of the connector is then snapped into place against the half shell interior surface. Preferably the second pair of snap fit points are in the form of bent arms which snap over a step along the edge of each half shell. Subsequent to snap fitting the second pair of snap fit points, the insert shape (tab) is bent into place against the exterior surface of the half shell, preferably bent into a recessed area on the surface of the half shell. The final result is five point positioning of the retention clip which aligns and secures the clip within the half shell.

DETAILED DESCRIPTION OF THE INVENTION

Figure 1A:
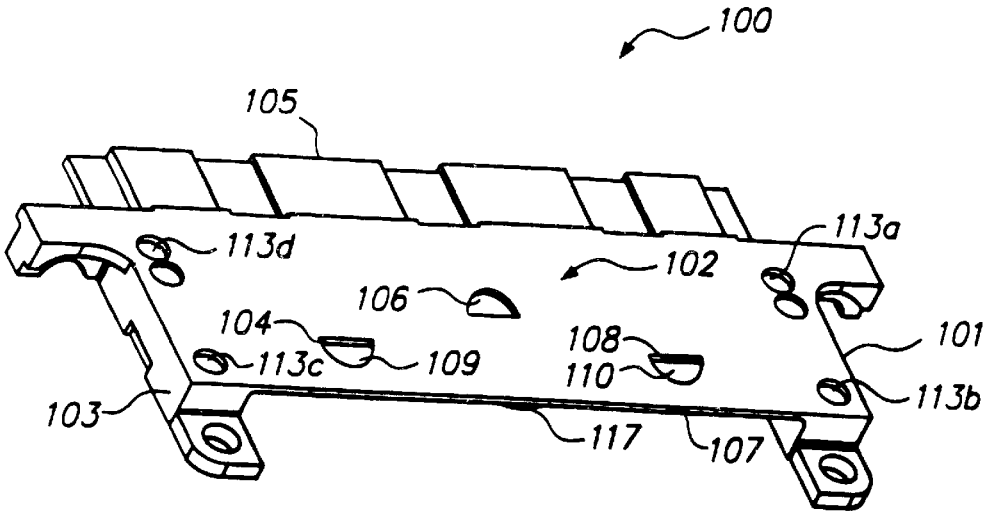
FIG. 1A shows a projected top view of a preferred embodiment half shell which makes up the upper half of a preferred embodiment connector housing.

The present invention pertains to an electrical connector assembly which includes an outer shell capable of receiving at least one electrical contact module. The outer shell is comprised of two half shells which work in cooperation with each other and an improved module retaining clip to secure the electrical contact module within the shell assembly . Typically two module retaining clips are used in a completed assembly, one clip attached to each half shell. This provides a more secure retention of the contact module and provides a precise alignment of the module both during and after insertion of the module into connector assembly.

In particular, the two shell halves are closed after attachment of a module retaining clip to each half shell. Preferably, the half shells, with module retaining clip in place, are permanently riveted or joined with an adhesive into the closed configuration. Typically the outer shell is rectangular in shape and is fabricated from aluminum which is cadmium or nickel plated.

Preferably the shell halves are cast (using standard casting techniques) rather than machined, to reduce costs. Casting is a much less expensive means of fabrication than machining and is particularly cost effective in the present instance where the shell is cast as two separate halves, enabling the use of a simplified mold for casting.

I. Definitions

As a preface to the detailed description, it should be noted that, as used in this specification and the appended claims, the singular forms "a", "an", and "the" include plural referents, unless the context clearly dictates otherwise. For example, "a wire" or "a wire bundle" refers to one or more wires or wire bundles and a "contact module" refers to one or more contact modules.

Specific terminology of particular importance to the description of the present invention is defined below.

The term "connector shell" refers to the wall of a connector assembly which provides at least a protective exterior and which typically but not necessarily provides electromagnetic shielding as well as performing other functional services.

The term "connector module" or "contact module" refers to an assembly which includes electrical contacts or terminals. Typically the assembly includes a dielectric material which separates electrically conductive contacts from each other and from the connector housing. The contact module assembly may also include a sealant material designed to prevent the entry of moisture or chemicals into the area of the electrically conductive contacts.

The term "electrical connector" refers to a device (plug or receptacle) which is brought into contact with another device (plug or receptacle) in order to make a path through which electrical conduction may occur.

The term "insert" or "insert shape", with reference to a portion of a retaining clip, is intended to mean a protrusion on the surface of the retaining clip which may be inserted into a depression or recession or through an opening in a connector housing or shell, but which does not provide a snap fit against the connector housing.

The term "leading end" refers to the end of an electrical connector which contains a transverse face or surface having electrical contacts contained therein and which is attached to another leading end of another electrical connector to form an electrically conductive path between the two connectors.

The term "retaining clip" refers to a retaining device which is used to hold a connector module in place once it is inserted within a connector housing.

The term "side edge" refers to a longitudinal edge of an electrical connector, two of which, in combination with a leading end and trailing end, form a rectangular-shaped connector.

The term "snap fit" with reference to a portion of a retaining clip, is intended to mean a shape on the retaining clip surface which engages with a shape on a surface of a connector housing or shell to fit tightly, providing an attachment point.

The term "trailing end" refers to the end of an electrical connector which is opposite the "leading end"; the trailing end is the end from which the wires (which are terminated to the connector electrical contact elements) extend.

II. The Preferred Embodiment Connector Shell Assembly

Figure 3A:
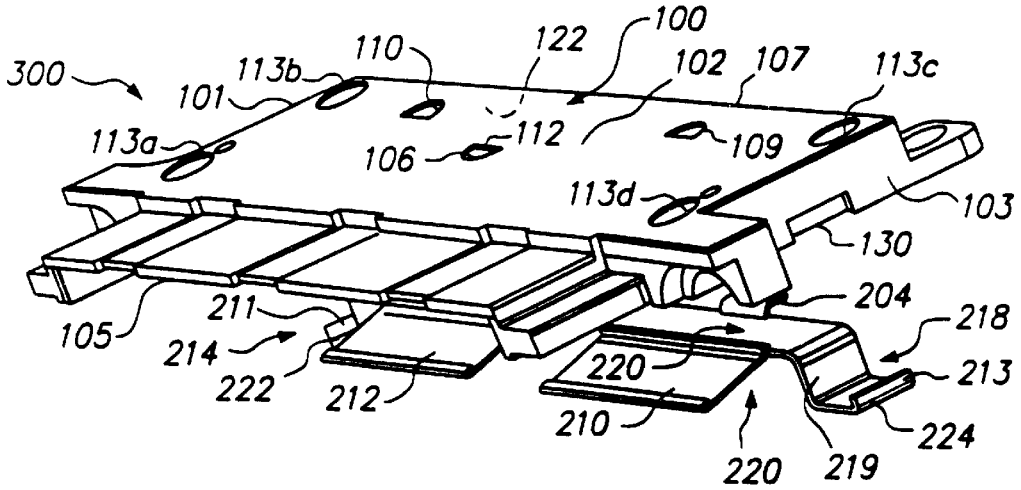
FIG. 3A shows a projected view of the upper half of a preferred embodiment connector assembly, including the upper half shell and cooperating upper module retaining clip.
Figure 3B:
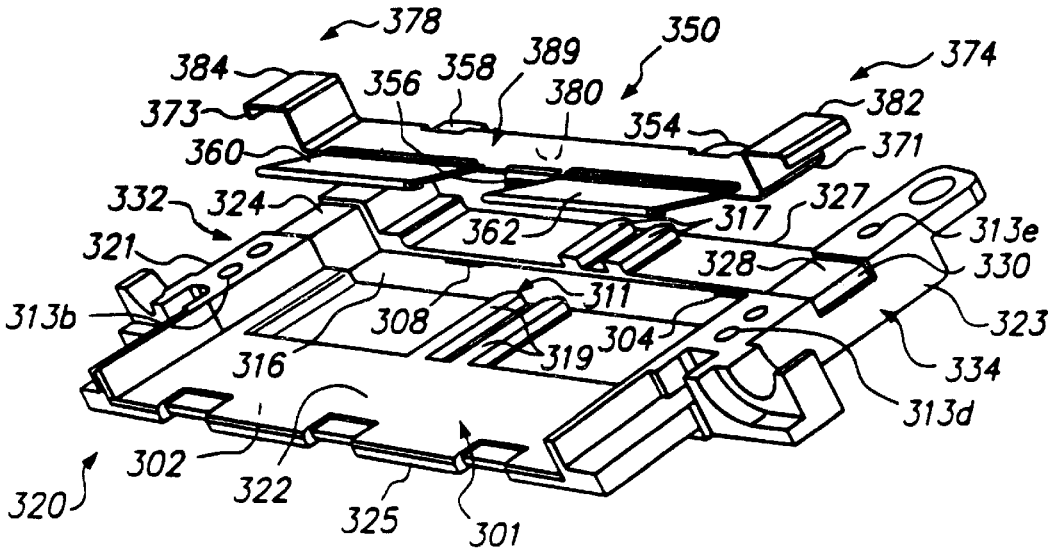
FIG. 3B shows a projected view of the lower half of a preferred embodiment connector assembly, including the lower half shell and cooperating lower module retaining clip. The retaining clip is shown with the leading edge tab bent into its final shape for purposes of illustration only. In fact, prior to snap fitting of the clip against the half shell, the leading edge tab has the configuration shown in FIGS. 2A and 2B.
Figure 4:
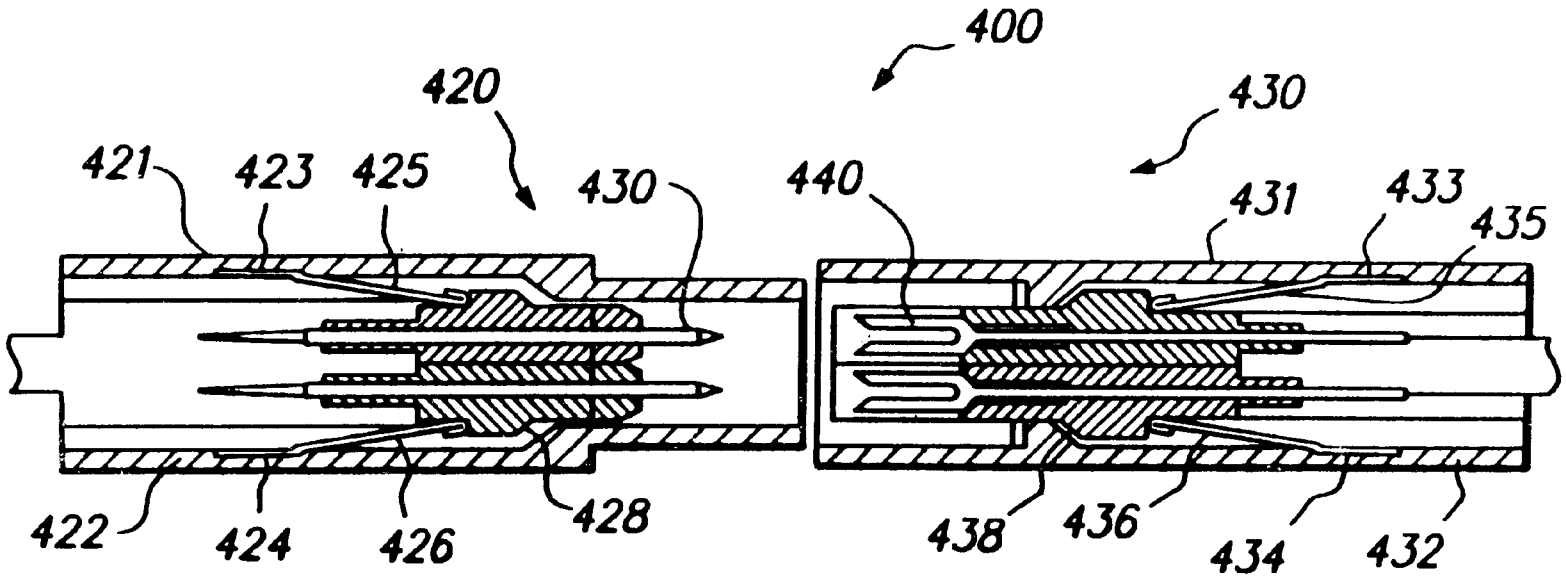
FIG. 4 shows a cross-sectional view of a plug and receptacle, each of which utilizes the present invention including the split shell with retention clip.

A cross-sectional view of an electrical connector plug and receptacle, each of which utilize the present invention split shell and retention clip is shown in FIG. 4. The principal difference in terms of the split shell is the leading edge of the split shell, where the leading edge of the plug designed to fit into the leading edge of the receptacle. The retention clips are essentially the same. An expanded view of an electrical connector plug including the complete split shell assembly is shown in the combination of FIGS. 3A and 3B. FIG. 3A shows the top half of the connector assembly and FIG. 3B shows the bottom half of the connector assembly. The difference between the top half and the bottom half of the connector assembly is minor, being principally a module orientation (guiding and supporting) shape on the interior surface of the connector which does not affect the relationship between the outer split shell and the module retaining device. With this in mind, this disclosure will begin with a detailed description of the top half of the connector assembly, as illustrated in FIGS. 1A and 1B.

Figure 1B:
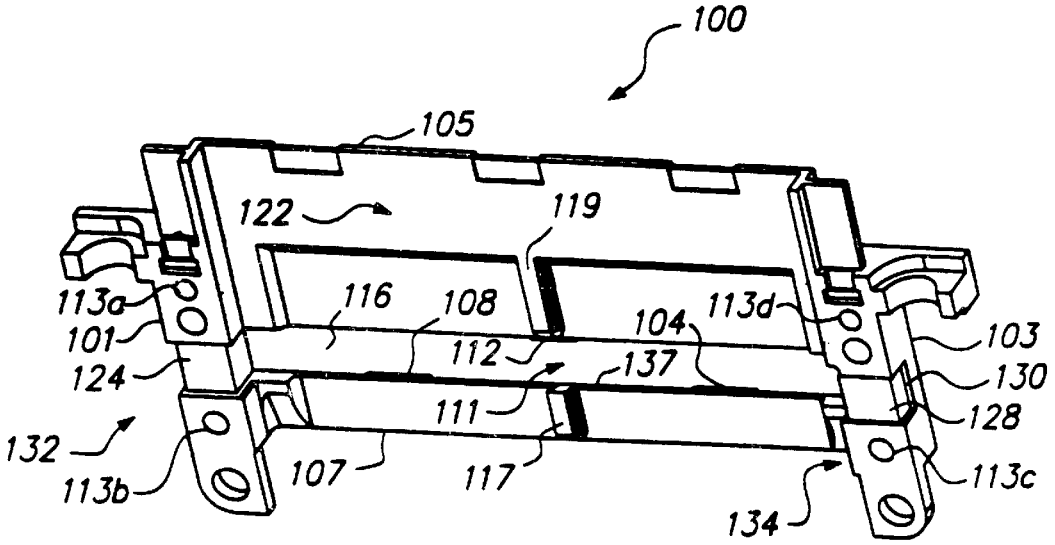
FIG. 1B shows a projected bottom view of the half shell shown in FIG. 1A.

FIG. 1A is a projected top view showing the upper surface 102 of the connector assembly top half shell 100. Top half shell 100 is generally rectangular in shape, having a leading end 105, a trailing end 107 and side edges 101 and 103. Top surface 102 comprises recessed shape 109, including opening 104; recessed shape 110, including opening 108; and recessed shape 106 having opening 112 (not shown). Snap fit bent tab 204 of retaining clip 200 shown in FIG. 2A passes through opening 104 and rests against the recessed surface 109. Snap fit bent tab 208 of retaining clip 200 passes through opening 108 and rests against the recessed surface 110. Tab insert 206 of retaining clip 200 passes through opening 112 (not shown on FIG. 1A, but shown as 112 on FIG. 1B) and is subsequently bent to rest against recessed surface 106. These three contact points ensure that retaining clip 200 is properly positioned against the bottom surface 122 of top half shell 100, which is illustrated in the bottom view of top half shell 100 illustrated in FIG. 1B. Bottom surface 122 of top half shell 100 also includes a recessed channel 111 in which transverse member 220 of retaining clip 200 rests. Further, recessed surfaces 124 and 128 in raised steps 132 and 134, respectively work in cooperation with snap-fit arms 214 and 218, respectively, to provide a contact location along side edges 103 and 101, respectively of top half shell 100. These two snap-fit contact locations prevent retaining clip 200 from becoming canted relative to side edges 103 and 101 of top half shell 100. The combination of the four snap-fit contacts with the one tab insert (which is bent into position after attachment of the retaining clip using the snap-fit contact points) assures that the retaining clip 200 is properly aligned with respect to top half shell 100. In addition, a load applied to retaining clip 200 is distributed along the entire length of transverse member 200, as retaining clip 200 edge 230, which is opposite module retaining arms 210 and 212 rests against recessed wall 137 of the bottom surface of top half shell 100. Top half shell 100 bottom surface 122 also includes structures 117 and 119 which help guide a contact module into an assembled shell assembly and to position the contact module within the assembly as shown in FIG. 4, which will be discussed in more detail subsequently.

Figure 2A:
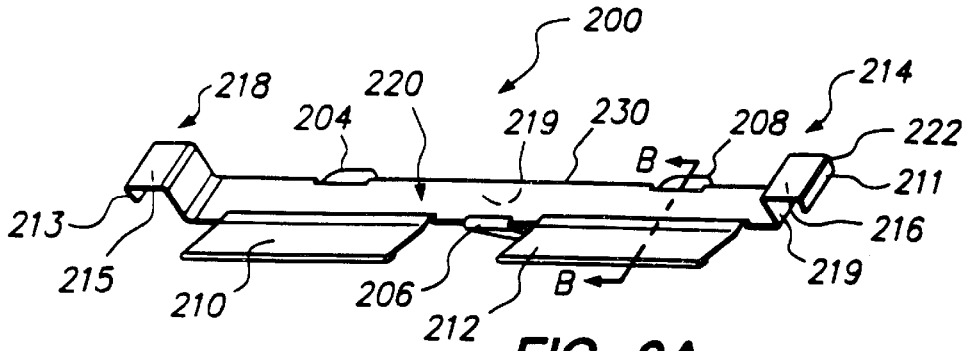
FIG. 2A shows a projected interior view of a preferred embodiment module retaining clip which is used in combination with the half shell of FIG. 1A, in the manner shown in assembly FIGS. 3A and 3B. The word interior is intended to mean that a major clip surface as shown in FIGS. 3A and 3B will be facing the interior of the assembled connector.

With reference to retaining clip 200 shown in FIG. 2A, module holding arms 210 and 212 extend from transverse member 200 and act to hold a contact module (not shown) in place after insertion into the interior of the connector assembly as shown in FIG. 4.

Figure 2B:
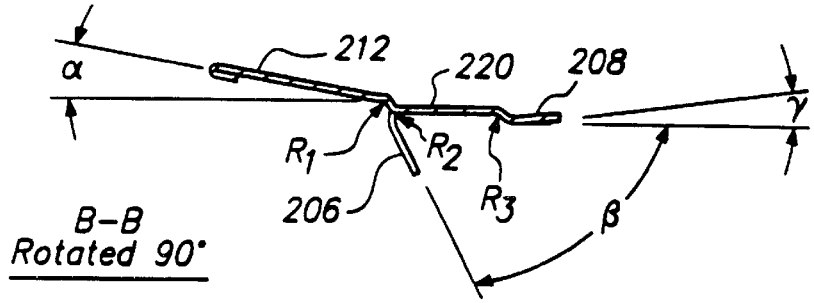
FIG. 2B shows a side view of the preferred embodiment retaining clip of FIG. 2A, as a cross-section of the clip at the location B—B. The view also includes the insert tab which is located at the center of the clip, but does not include the bent arm at the end of the clip, for purposes of illustration.

A schematic of a cross-sectional view of the module retaining clip through Section B—B shown on FIG. 2A, is provided in FIG. 2B. This view shows the various angles and radii which are included in retaining clip 200. The radii $R_1$, $R_2$, and $R_3$, provide clearances for the insertion of a contact module (not shown) into the shell assembly (exploded view shown in FIGS. 3A and 3B). The angle $\alpha$, must be carefully controlled, to permit proper retention of a contact module within the shell assembly, as shown in FIG. 4. The angle $\beta$ provides clearance for insertion of retention clip 200 into split shell top half 100 and contributes to the snap fit of the clip 200 into top half shell 100. The angle $\gamma$ prevents portions of the clip 200 from hanging down inside the shell assembly in a manner which would catch on a contact module as it is inserted or removed. The portion of the cross-section which would represent snap fit arm 218 in Section B—B is not shown, to provide for clarity in the description.

In particular, angle $\alpha$, which typically ranges from about 9° to about 15°, and most preferably is about 12±1° provides a spring action for module retaining arm 212 of retaining clip 200, when the clip 200 is fabricated from the proper material and is properly attached to the bottom surface 122 of top half shell 100. The material of construction for retaining clip 200 must have a springy quality. The spring action permits the retaining arms 210 and 212 to bend, permitting insertion of a contact module into the connector assembly and then to spring back, holding the contact module in place after insertion. Materials having this springy quality include, for example, but are not limited to, beryllium copper and stainless steel alloys. Most preferably, the retaining clip 200 is fabricated from stainless steel alloys.

A retaining clip 200 angle $\beta$ which falls within a range of about 60° to about 70° provides adequate clearance for insertion of retaining clip 200 insertion into split shell top half 100 and contributes to the snap fit of snap fit tabs 204 and 208 against recessed surfaces 104 and 108, respectively. A retaining clip 200 angle $\gamma$ which falls within a range from 0° to about 10°, is adequate to maintain the retaining clip 200 in its proper resting place within recessed channel 111 so that retaining clip 200 will not interfere with the insertion of a contact module into the shell assembly shown in an expanded view in FIGS. 3A and 3B.

Essentially the same cross sectional schematic as that shown in Section B—B could be drawn for a section through contact module retaining arm 210 and pre-bent tab 204.

Figure 2C:
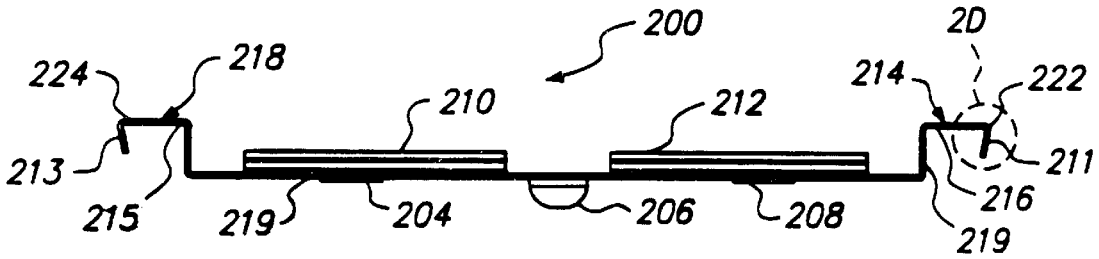
FIG. 2C shows a facial view of the FIG. 2A retaining clip from the trailing end (the end from which the wires of the connector extend) of the connector assembly.
Figure 2D:
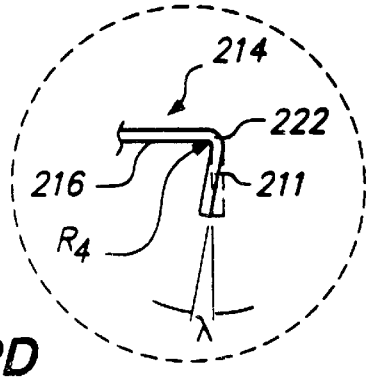
FIG. 2D shows an expanded view of the outer edge of the retaining clip of FIG. 2C, which outer edge forms a snap fit against the outer edge of a half shell.

FIG. 2C shows a facial view of retaining clip 200, with emphasis on snap fit arms 214 and 218 which rest upon recessed surfaces 124 and 128 in raised steps 132 and 134, respectively. FIG. 2D shows the detail of the bend 222 along the outside portion of snap fit arm 214 to form a snap fit contact lever arm 211. This bend 222 provides a set of snap fit contact points. A first contact point occurs where a horizontal portion 216 of snap fit arm 214 rests against recessed surface 124 on the interior or bottom surface 122 of top half shell 100, and a second contact point occurs where lever arm 211 of arm rests against a recessed surface (not shown) on side edge 101. FIG. 2D shows a Radius $R_4$ which depends on the dimensions of the retaining clip and the angle $\lambda$, which typically ranges about 7° and about 15°. Angle $\lambda$ and Radius $R_4$ contribute to the snap fit contacts along edges side 101 and 103 of top half shell 100, as previously discussed.

When the surface 219 of the retaining clip 200 is placed adjacent to the interior surface 122 of the top half shell 100, the pre-bent tabs 204 and 208 can be made to slide into position through openings 104 and 108, respectively, in the top half shell 100, and to come to rest against recessed surfaces 109 and 110, respectively on the exterior surface 102 of the half shell 100. As the pre-bent tabs 204 and 208 slide into position, insert tab 206 is inserted through opening 112 in top half shell 100, to extend up through the exterior surface 102 of the top half shell 100. This provides a three point alignment and a secure attachment of the retaining clip 200 to the top half shell 100 in the direction from leading edge 105 to trailing edge 103 of the connector assembly. A second pair of snap fit contacts, which align and secure the retaining clip 200 against the top half shell 100 interior surface 122 relative to the side edges 101 and 103 of the connector are then snapped into place. The second pair of snap fit contacts are in the form of snap fit arms 214 and 218 which snap into place against the recessed channel 111 on bottom, interior surface 122. A first snap-fit contact is generated where the horizontal portion 216 of snap fir arm 214 rests against recessed surface 124 of channel 111, while the bent portion 211 rests against a recessed surface (not shown) on side edge 103. A second snap-fit contact is generated where the horizontal portion 215 of snap fit arm 218 rests against recessed surface 128 of channel 111, while the bent portion 213 rests against a recessed surface 130 on side edge 105. Subsequent to snap fitting the second pair of snap-fit contacts, the insert tab 206 is bent into place against the exterior surface 102 of the top half shell 100, to rest against recessed area 106. The final result is five point positioning of the retention clip 200, which aligns and secures the clip within the top half shell 100.

One of the preferred embodiment shell and clip assemblies described above has the following dimensions with respect to FIGS. 1A, 1B, 2A, 2B, and 2C. The length of top half shell 100 from leading edge 105 to trailing edge 107 is approximately 1.5 inches. The width of top half shell from side edge 101 to side edge 103 at its broadest dimension is approximately 3 inches. The corresponding retaining clip has a width from bent arm 211 of snap fit arm 214 to bent arm 213 of snap fit arm 218 of about 2.5 inches, and a length from the leading edges of bent tabs 204 and 208 to the trailing edges of module retaining arms 210 and 212, respectively of about 2.5 inches.

The same description regarding the positioning and attachment of the retaining clip to the half shell is applicable with regard to the bottom retaining clip and the bottom half shell.

FIGS. 3A and 3B in combination provide an exploded view of one connector assembly. FIG. 3A represents the top half 300 of the assembly and FIG. 3B represents the bottom half 320 of the assembly. The exterior surfaces 102 of top half shell 100 and 302 of bottom half shell 301 provide a protective connector assembly exterior which encompasses at least the portion of a contact module (not shown) necessary to provide proper electrical engagement when two connector assemblies, a plug and a receptacle, containing the proper interfacing electrical contacts are joined.

FIG. 3A shows the top half 300 of the assembly, illustrating top half shell 100 and showing exterior, upper surface 102; interior, lower surface 122; leading end 105; trailing end 107 and side edges 101 and 103. Exterior, upper surface 102 shows recessed areas 106, 109, and 110 which make contact with tabs 206, 204, and 208, respectively of retention clip 200. Also illustrated in FIG. 3A is recessed area 130 along side edge 103 which makes contact with a portion of snap fit arm 218 of retention clip 200. Top half shell 100 works in cooperation with top retaining clip 200. The illustration of top retaining clip 200 shows an upper surface 220, which attaches to bottom surface 122 of top half shell 100. Top retaining clip 200 includes pre-bent tabs 204 and 208 for snap fitting into top half shell 100; only one of these pre-bent tabs, 204 is visible. Top retaining clip 200 snap fit arms 214 and 218 snap fit onto top half shell 100; only one of the snap fit arms, 218, is shown in detail. Snap fit arm 218 includes a bend 224 and a lever arm 213 which makes contact against recessed area 130 along side edge 103. Snap fit arm 214 includes equivalent functional elements. Top retaining clip 200 includes two module retaining arms 210 and 212.

FIG. 3B shows the bottom half 320 of the assembly, including bottom half shell 301 having exterior, lower surface 302; interior, upper surface 322; a leading end 325, a trailing end 327, and side edges 321 and 323. Interior, upper surface 322 includes openings 308 (for insertion of corresponding retention clip 350 pre-bent tab 358) and 304 (for insertion of pre-bent tab 354) which are visible and a third opening (for insertion of insert tab 536) which is not visible. Also illustrated in FIG. 3B are recessed channel 311 which travels across upper surface 322 of bottom half shell 301 in a transverse direction; recessed steps 332 and 334; and recessed exterior area 330 on side edge 323. Pairs of reinforcement bars, 317 and 319 travel along upper surface 322 in a longitudinal direction, to help guide and position a contact module (not shown) which is inserted into the shell and clip assembly. Bottom half shell 320 works in cooperation with bottom retaining clip 350. Bottom retaining clip 350 includes a lower surface 380 which attaches along bottom recessed channel 311 of upper, interior surface 322 of bottom half shell 320. Bottom retaining clip 350 includes pre-bent tabs 354 and 358 for snap fitting into bottom half shell 320 through openings 304 and 308, respectively. Bottom retaining clip 350 also shows insert tab 356 which inserts through an opening (not shown) on interior surface 322. In addition, bottom retaining clip 350 shows snap fit arms 374 and 378, which snap fit onto bottom half shell 320 over recessed steps 334 and 332, respectively. Snap fit arm 374 shows a bend 382 and a lever arm 371 which makes contact against recessed area 330 along side edge 323. Snap fit arm 378 shows a bend 384 and a lever arm 373 which makes contact against a recessed area (not shown) along side edge 321. Bottom retaining clip 350 also shows the two module retaining arms 360 and 362.

After attachment of top retaining clip 200 to top half shell 100 and attachment of bottom retaining clip 350 to bottom half shell 320, top half 300 and bottom half 320 of the assembly are joined together, preferably by riveting. The riveting locations are shown in FIG. 1A at locations 113*a* through 113*d*. The riveting locations are also shown in FIG. 3B at locations 313*b* through 313*d* (313*a* is hidden).

FIG. 4 shows a cross-sectional view of an entire electrical connection 400, including a plug 420 and a receptacle 430. Plug 420 includes top half shell 421, which works in cooperation with top retention clip 423 having module retaining arm 425. Plug 420 also includes bottom half shell 422, which works in cooperation with bottom retention clip 424 having module retaining arm 426. A contact module 428; having electrical contacts 430 is shown retained by retention clips 423 and 424. Receptacle 430 includes top half shell 431, which works in cooperation with top retention clip 433 having module retaining arm 435. Receptacle 430 also includes bottom half shell 432, which works in cooperation with bottom retention clip 434 having module retaining arm 436. A contact module 438; having electrical contacts 440 is shown retained by retention clips 433 and 434.

III. A Method of Assembling the Preferred Embodiment Connector Assembly

The use of two half shells each having a module retaining clip attached thereto gives rise to a particular method of fabricating an electrical connector assembly. The method is as follows.

With reference to FIGS. 1A, 1B, and 2A:

a) a retention clip 200 is attached to the interior of surface 122 of a half shell 100 as follows:
   - i) inserting pre-bent tabs 204 and 208 through openings 104 and 108 from interior surface 122 of half shell 100, immediately followed by the insertion of insert tab 206 through opening 112 located on interior surface 122 of half shell 100.
   - ii) while inserting pre-bent tabs 204 and 208, lower surface 219 of retaining clip 200 is placed in contact with recessed channel 111 on the interior surface 122 of half shell 100. Contact between lower surface 219 of retaining clip 200 transverse member 220 extends the entire length of recessed channel 111.
   - iii) lower surface 219 of snap fit arms 218 and 214 is placed in contact with the recessed surface of steps 128 and 124 respectively and snapped into place so that horizontal portion 215 of snap fit arm 218 rests against recessed surface 128 of channel 111, while the bent portion 213 rests against a recessed surface 130 on side edge 105. Essentially simultaneously, horizontal portion 216 of snap fit arm 214 rests against recessed surface 124 of channel 111, while the bent portion 211 rests against a recessed surface (not shown) on side edge 101.

b) insert tab 206 is bent over to make contact with recessed area 106 on the exterior, upper surface 102 of half shell 100.

With reference to FIGS. 3A and 3B:

c) the procedure described in steps a) and b) above with reference to a half shell and a retaining clip is carried out twice, once with respect to the top half of an assembly 300 and once with respect to the bottom half of an assembly 320.

d) assembly top half 300 is brought into contact with assembly bottom half 320 so that portions of interior, lower surface 122 of top half 300 are in contact with portions of the interior, upper surface 301 of bottom half 320, whereby an aligned rectangular-shaped connector exterior housing is produced.

e) assembly top half 300 is fastened to assembly bottom half 320.

Preferably the attachment of assembly top half 300 to assembly bottom half 320 is by a permanent means, such as riveting. Other joining means, both permanent and non-permanent, such as soldering, adhesive bonding, and screwing are also contemplated.

Particular advantages to this connector assembly include: 1) the five point contact alignment, which precisely aligns the retaining clip within the connector split shell assembly, ensuring solid parallel alignment of the interfacing contact surfaces of a contact module inserted therein and reliable electrical engagement when two connector interfaces are joined; 2) the fact that the retaining clip force loading is extended over the entire transverse member of the retaining clip (the edge of the retaining clip rests against a recessed wall surface within the half shell); 3) the fact that there is no exposed protrusion on the interior of the assembly which can interfere with the insertion of a contact module, reducing the possibility of a rupture in the interfacial seal portion of the contact module; and, 4) the fact that once the connector is fully assembled, the retaining clip is locked into position within the interior of the housing by contact with interior housing surfaces, so that if one or all of the tabs (both the pre-bent and insert tabs) are broken off for any reason, the connector will remain functional without any movement of the electrical components within the housing.

The above described preferred embodiments are not intended to limit the scope of the present invention, as one skilled in the art can, in view of the present disclosure, expand such embodiments to correspond with the subject matter of the invention claimed below.

We claim:

1. An electrical connector assembly comprising two half shells which are joined together to form a connector housing, wherein, prior to said joining, each half shell has attached thereto a separate module retaining device which is positioned within each said half shell by a minimum of three contact points in each respective half shell such that the module retaining devices are positioned between the half shells, wherein at least two of said contact points are snap-fit attachments, and wherein each said module retaining device comprises a portion disposed between said two half shells and wherein each of said half shells includes a recessed surface for receiving said portion, and wherein, in use, a module is positioned between said module retaining devices, wherein said module retaining device both aligns and secures the module inserted into said connector housing.

2. The electrical connector assembly according to claim 1, wherein said portion comprises a snap-fit attachment.

3. The electrical connector assembly according to claim 1, wherein there are five contact points, and at least four of said contact points are snap-fit attachments.

4. The electrical connector assembly according to claim 1, wherein one of said contact points comprises an insert which passes through an opening in said half shall and wherein said at least two snap-fit attachments are pre-bent inserts, each of which passes through an opening in said half shell.

5. The electrical connector assembly according to claim 4, including two additional snap-fit attachment points which do not pass through an opening in said half shell.

6. The electrical connector assembly according to claim 1, wherein said three contact points align said module retaining device with respect to a leading edge and trailing edge of said connector.

7. The electrical connector assembly according to claim 3, wherein two of said four snap-fit attachment points align the module retention device with respect to the side edges of said connector.

8. An electrical connector assembly comprising a pair of half shells, each having attached thereto a separate retaining clip, wherein each said half shell includes a recessed channel along an interior surface and at least two openings passing from an interior of said half shell to an exterior of said half shell, wherein said retaining clip includes at least two pre-bent tabs which pass through said at least two openings, and wherein a major surface of each of said retaining clip is snap fitted to rest against said interior surface on said recessed channel surface of said respective half shell, such that the retaining clips are disposed between the half shells.

9. An electrical assembly according to claim 8 wherein each said retaining clip comprises a portion disposed between said two half shells.

10. An electrical connector assembly according to claim 8, wherein said half shell also includes at least two step features, with each of said step features having at least two surfaces having recessed areas thereon, and wherein said retaining clip includes corresponding lever arms, which lever arms form a snap fit with said at least two step features having recessed areas thereon.

11. The electrical connector assembly according to claim 1 wherein, prior to said joining and prior to positioning of said module retaining device, said module retaining device is an element detached from each said half shell.

12. The electrical connector assembly according to claim 1 wherein, in use, said module inserted into said connector assembly is removable without disassembly of said connector housing.

* * * * *